US007261605B2

(12) United States Patent
Misao et al.

(10) Patent No.: US 7,261,605 B2
(45) Date of Patent: Aug. 28, 2007

(54) TROLLING DEVICE

(75) Inventors: Hideo Misao, Amagasaki (JP); Ryouichi Kawai, Amagasaki (JP); Takayuki Toda, Amagasaki (JP)

(73) Assignee: Kanzaki Kokyukoki Mfg. Co., Ltd., Hyogo-ken (JP)

( * ) Notice: Subject to any disclaimer, the term of this patent is extended or adjusted under 35 U.S.C. 154(b) by 27 days.

(21) Appl. No.: 11/481,016

(22) Filed: Jul. 6, 2006

(65) Prior Publication Data

US 2007/0026748 A1 Feb. 1, 2007

(30) Foreign Application Priority Data

Jul. 28, 2005 (JP) ..... 2005-218437

(51) Int. Cl.
*B63H 20/14* (2006.01)

(52) U.S. Cl. ..... 440/75

(58) Field of Classification Search ..... 440/6, 440/75

See application file for complete search history.

(56) References Cited

U.S. PATENT DOCUMENTS 4,378,219 A * 3/1983 Tanaka ..... 440/75
4,820,209 A * 4/1989 Newman ..... 440/74
5,018,996 A * 5/1991 Newman et al. ..... 440/75
5,171,170 A * 12/1992 Ridder et al. ..... 440/1
5,639,272 A * 6/1997 Henderson et al. ..... 440/6

FOREIGN PATENT DOCUMENTS

JP A-H06-80098 3/1994
JP A-H06-201029 7/1994

* cited by examiner

*Primary Examiner*—Stephen Avila
(74) *Attorney, Agent, or Firm*—Posz Law Group, PLC

(57) ABSTRACT

An object of the present invention is to provide a trolling device which can reduce the operational force of a trolling lever while the oil pressure setting of a marine gear is raised to increase the capacity of a transmission torque. The trolling device has a pressure reducing valve 23 for reducing clutch oil pressure and a low speed valve 22 for adjusting the spring force of a pilot spring 24 of the pressure reducing valve 23 in conjunction with a trolling lever 25, the low speed valve 22 having a protrusion 22*a* which extends inside a coil spring constituting the pilot spring 24 to the side of the pressure reducing valve 23 and comes into contact with the pressure reducing valve 23 at least when forward and reverse clutches are fully engaged, the protrusion 22*a* having a drain oil passage 22*c* which comes into communication with an orifice 23*c* when in contact with the pressure reducing valve 23 during trolling and discharges drain oil from the orifice 23*c*.

1 Claim, 4 Drawing Sheets

[fig.1]
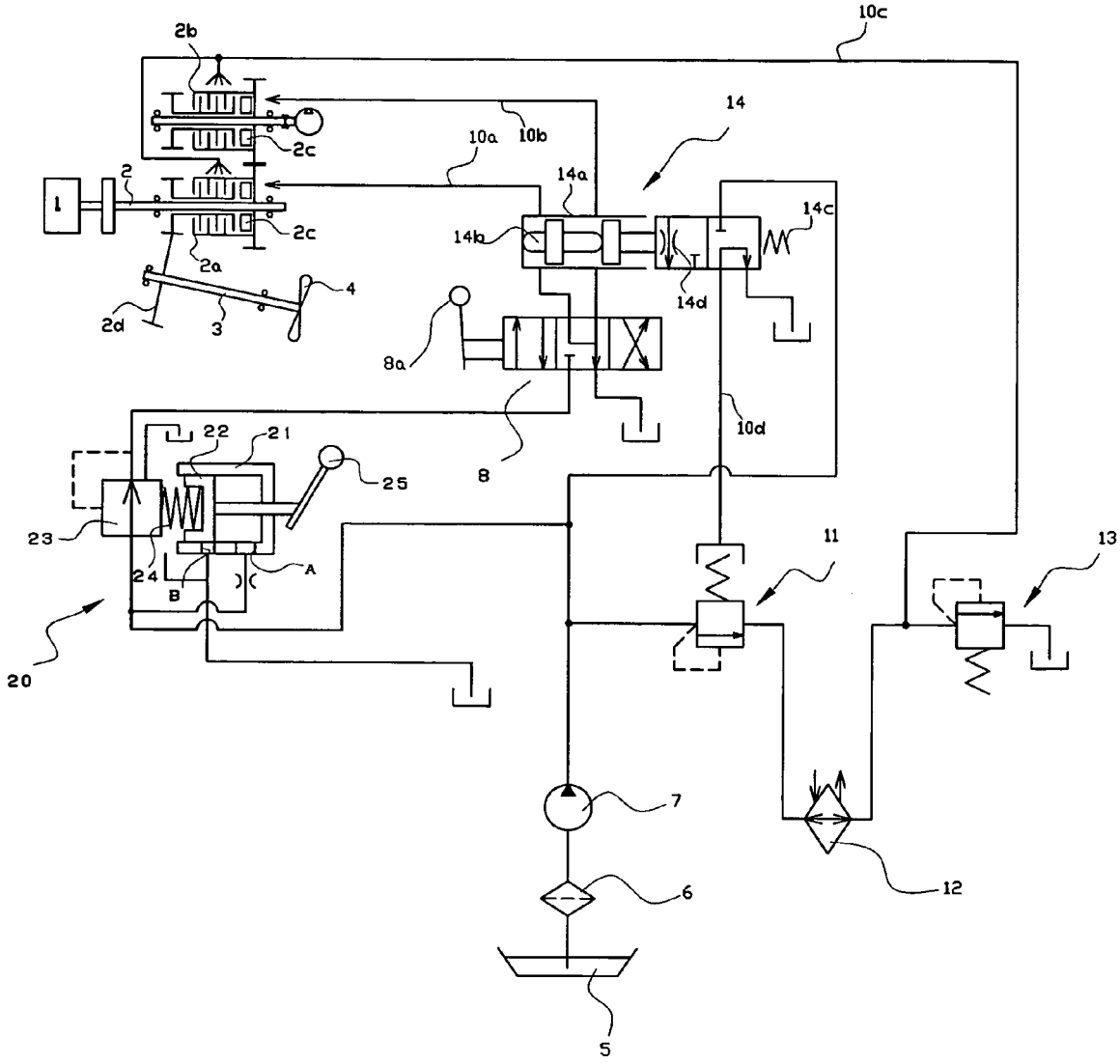

[fig.2]
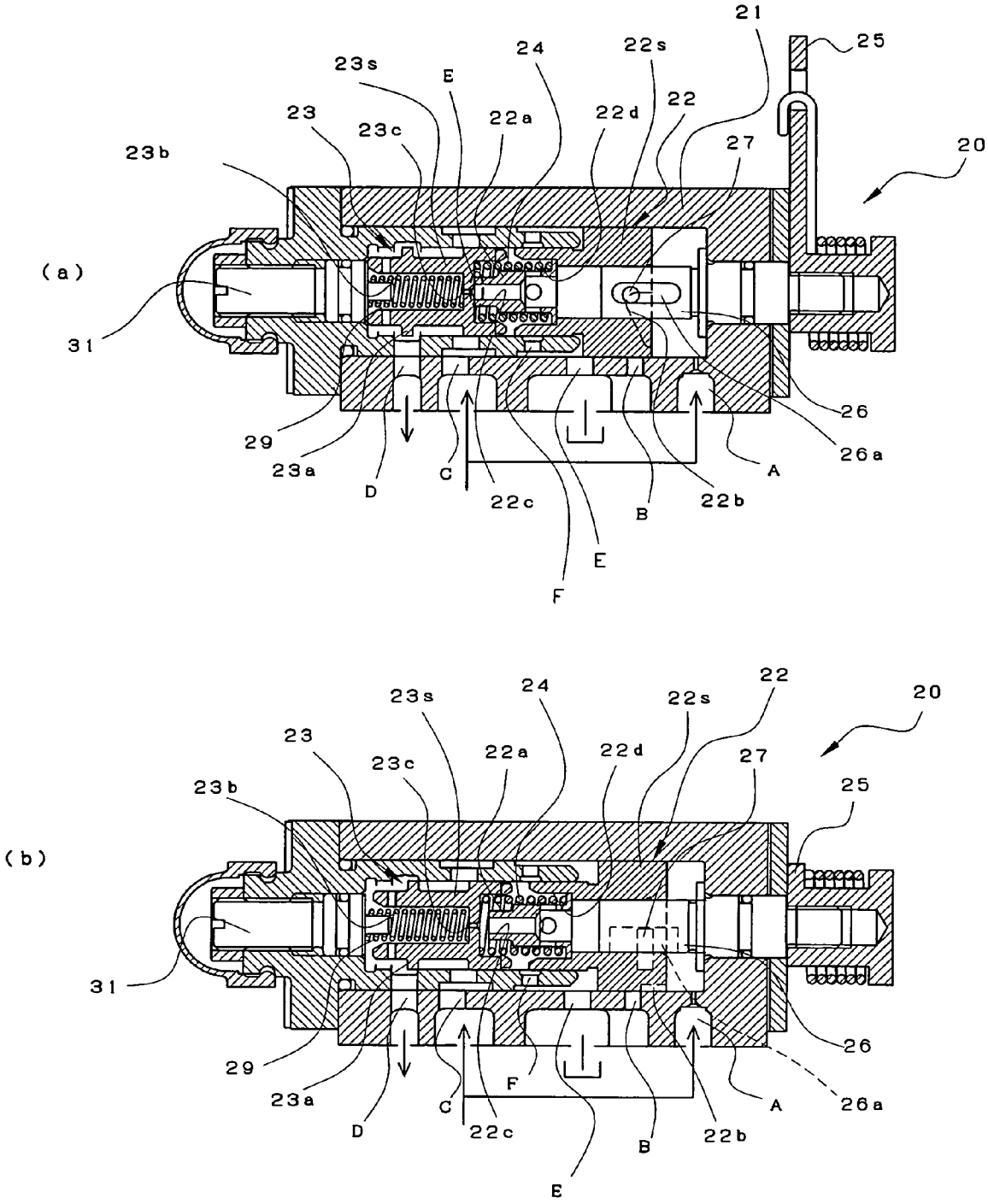

[fIg.3]
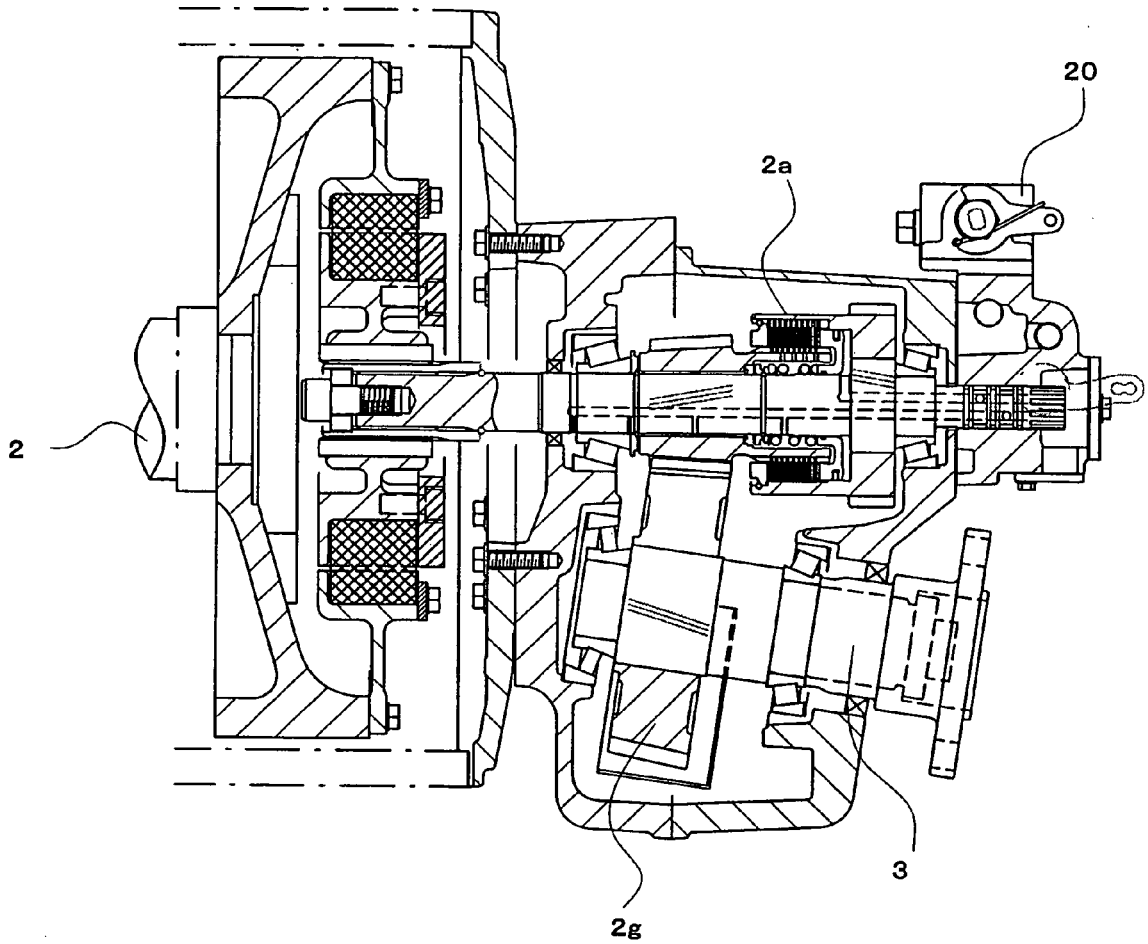
[fIg.4]
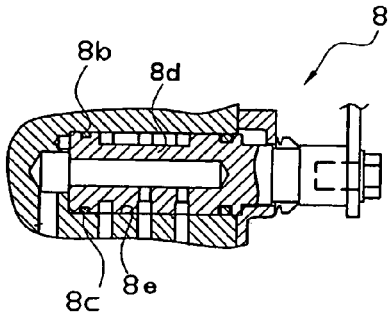

[fig.5]
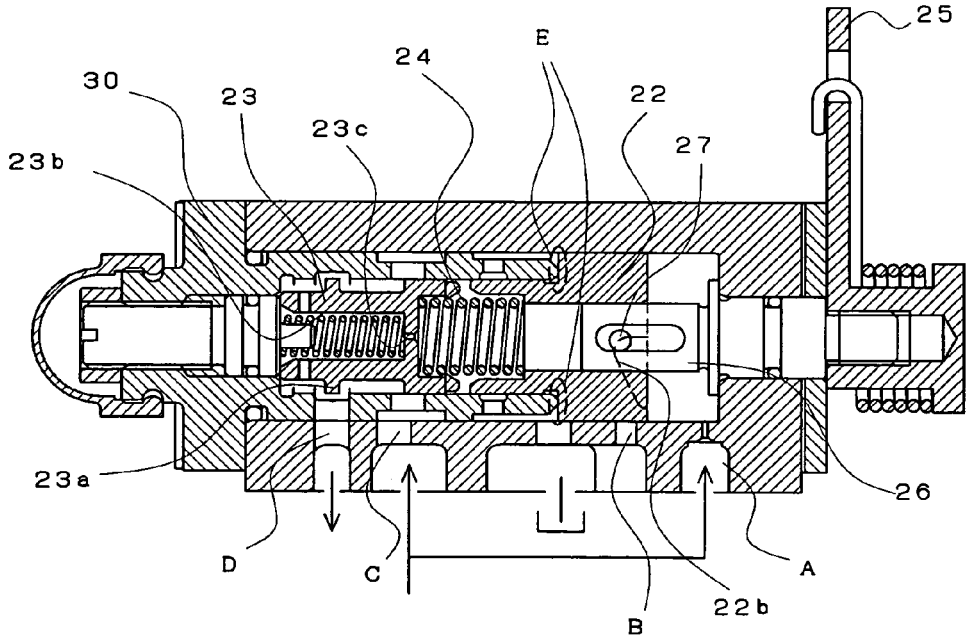

TROLLING DEVICE

TECHNICAL FIELD

The present invention relates to a trolling device of a marine gear, more specifically to a trolling device which can reduce the operational force of a trolling lever.

BACKGROUND OF THE INVENTION

Small crafts, such as fishing boats, fishing leisure boats, and the like, are frequently required to travel at quite low-speeds for some uses. For example, the following cases can be cited: stopping at fishing grounds; crafts stopping at a fixed point against a current without anchoring; traveling at a slow speed in accordance with the net hauling speed so as not to apply an excessive load to the net and to avoid tangling the net around the propeller during net hauling, etc.

As a device for achieving such travel, a trolling device mounted on a speed reducing and reversing apparatus provided with a friction disc hydraulic clutch is conventionally known (Patent Document 1).

The trolling device is so constituted that the speed of the craft can be adjusted by alternatively selecting an oil pressure at which a clutch can be fully connected and an oil pressure at which the clutch can be incompletely connected (half-clutch state) by rotating an operation lever.

With increase in engine outputs in marine gears, higher capacity of transmission torque is required. Increasing the number of friction discs in the clutches or the like can increase the capacity of the transmission torque, but doing so may cause problems such as an increased size of the marine gear body.

Accordingly, in order to increase the capacity of the transmission torque and also maintain the size of the marine gear body, the surface pressure of the friction discs needs to be raised to increase of the oil pressure setting of the marine gear.

[Patent Document 1] Japanese Unexamined Patent Publication No. H06-80098

SUMMARY OF THE INVENTION

Object of the Invention

However, when the oil pressure setting of the marine gear is raised, a greater operational force is required for rotating the trolling lever to attain a trolling state in the trolling device, producing the problem of poor operability or the like.

Accordingly, an object of the present invention is to provide a trolling device which can reduce the operational force of the trolling lever, while increasing the oil pressure setting of the marine gear and the capacity of the transmission torque.

MEANS FOR ACHIEVING THE OBJECTS

As a means for solving the problems, a trolling device according to the present invention is for controlling a clutch oil pressure by rotationally operating a trolling lever, the trolling device having a pressure reducing valve for reducing the clutch oil pressure and a low speed valve for adjusting the spring force a pilot spring of the pressure reducing valve in conjunction with the trolling lever, the low speed valve comprising a spool connected on the trolling lever unrotatably relative to a lever shaft of the trolling lever and freely slidably along the shaft, the spool having one end being in contact with the pilot spring, and the other end receiving primary pressure oil of the pressure reducing valve, a notch groove for discharging the pressure oil into a drain depending on the angle of rotational operation of the trolling lever being formed on a land of the spool, the trolling device being so constituted that forward and reverse clutches are fully engaged by bringing the notch groove into a closed position and a trolling state is attained by bringing the notch groove into an open position, the pressure reducing valve comprising a spool provided with a pilot oil pressure chamber and an orifice formed therein, the pilot oil pressure chamber using the secondary pressure oil of the pressure reducing valve as a pilot pressure and the orifice for draining oil from the pilot oil pressure chamber to a drain, the low speed valve having a protrusion which extends inside a coil spring constituting the pilot spring to the side of the pressure reducing valve and comes into contact with the pressure reducing valve at least when the forward and reverse clutches are fully engaged, the protrusion having a drain oil passage which comes into communication with the orifice when in contact with the pressure reducing valve during trolling to discharge drain oil from the orifice.

EFFECT OF THE INVENTION

According to the present invention, the protrusion formed on the low speed valve is brought into contact with the pressure reducing valve through the inside of the pilot spring, whereby the contact area of the low speed valve can be reduced and lowered operability of the trolling lever by raising the oil pressure setting of the marine gear can be prevented.

BEST MODE FOR CARRYING OUT THE INVENTION

Embodiments of the trolling device according to the present invention will be described below with reference to the accompanying drawings. It should be noted that similar components are referred to by the identical numerals throughout the drawings including prior art components.

FIG. 1 is an oil pressure circuit diagram of a marine gear (marine speed reducing and reversing apparatus) with a trolling device which is an embodiment of the present invention attached thereto. As shown in FIG. 1, an input shaft 2 extending from an engine 1 is provided with a forward clutch 2*a* and a reverse clutch 2*b*.

The forward clutch 2*a* and reverse clutch 2*b*, of which detailed illustration is omitted, are both constituted of friction discs and steel plates which are alternately disposed (refer to FIG. 3). The steel plates are connected to inner gears (pinion gears), and the friction discs are connected to outer gears which are always in rotation. These are so constituted that pressing them by hydraulic pistons 2*c* causes the outer gears and the inner gears to rotate together, a large gear 2*d* engaging the inner gears to rotate, and driving force to be transmitted to a propeller 4 from the large gear 2*d* via a propeller shaft 3.

It is also designed to enable trolling by adjusting the pressing force of the hydraulic pistons 2*c* to allow the friction disc to slip against the steel plate to produce a so-called half-clutch state.

A method of providing an hydraulic oil comprises the steps of supplying the oil to a trolling device 20 by highly pressurizing a hydraulic oil of an oil tank 5 by a pump 7, adjusting the hydraulic pressure at the trolling device 20, feeding the hydraulic oil under the adjusted pressure from a forward/reverse directional control valve 8 to the hydraulic pistons 2*c* through oil circuits 10*a*, 10*b* to transmit rotational force for advancing or reversing the propeller 4 by operating a forward clutch 2*a* or a reverse clutch 2*b*.

Moreover, a loose-fitting valve 11 is provided for preventing the forward and reverse clutches 2*a*, 2*b* from abruptly engaging when the forward/reverse directional control valve 8 is switched. In the FIG. 1, the numeral 12 represents an oil cooler, and the numeral 13 represents a lubricating oil pressure setting relief valve.

The loose-fitting valve 11 is a type of pressure control valves, and is operated by a two position control valve 14 using the oil pressure of an forward oil circuit 10*a* and reverse oil circuit 10*b* as a pilot pressure. This two position control valve 14 comprises a cylinder 14*a*, a piston 14*b* and a return spring 14*c*. When an pressure oil flows to the forward oil circuit 10*a* and reverse oil circuit 10*b* and the oil pressure in the cylinder 14*a* is increased, the piston 14*b* moves to switch the switching valve 14 so that the hydraulic oil under a flow rate controlled by the restrictor 14*d* flows. After the oil is forced into the pilot oil pressure chamber of the loose-fitting valve 11 and the forward/reverse directional control valve 8 is switched, the biasing force of a relief spring is gradually increased, that is, the relief pressure setting of the loose-fitting valve 11 is gradually increased via a control piston until a predetermined time is reached. In the position where the biasing force of the spring is maximized, the pressure at which the clutch is fully engaged is attained. Moreover, the device is so constituted that when the oil pressure is cut, the switching valve 14 brought back into a neutral state by the biasing force of the return spring 14*c*, which stops the flow of the hydraulic oil and the control piston of the loose-fitting valve 11 is reset to its original position.

That is, when the forward/reverse directional control valve 8 is in a neutral position, the two position control valve 14 is also in a neutral state, preventing the pressure oil from being supplied to the pilot oil pressure chamber of the loose-fitting valve 11. At this time, the spool of the loose-fitting valve 11 is therefore retracted to a great extent to serve as the relief valve with a low relief pressure, and part of the pressure oil provided from the pump 7 is discharged by the relief operation of the loose-fitting valve 11 and released to a lubricating oil path 10*c* through the oil cooler 12.

It should be noted that the oil pressure released from the loose-fitting valve 11 into the lubricating oil path 10*c* is defined by the lubricating oil pressure setting relief valve 13 to a predetermined low pressure.

When a forward/reverse control lever 8*a* is operated to switch the forward/reverse directional control valve 8 to a forward or reverse position, the two position control valve 14 is also moved by the piston 14*b* by using the pressure of the hydraulic oil which begins to flow through the oil circuits 10*a*, 10*b* as a pilot pressure. Thereby, the oil passage is opened, and simultaneously the flow rate is controlled by the restrictor 14*d* provided in the two position control valve 14. The hydraulic oil is therefore forced into the pilot oil pressure chamber of the loose-fitting valve 11 via the hydraulic circuit 10*d*. This forcing of the oil moves the spool forward to gradually increase relief pressure, thereby gradually closing the lubricating oil path 10*c*. As reflex action of the gradually closing action, the hydraulic oil pressures of the forward and reverse clutches 2*a*, 2*b* are gradually increased, thereby avoiding sudden contact of the clutches. Finally, the clutches 2*a*, 2*b* are completely pressed by a high pressure to fully transmit the driving force.

It should be noted that in the forward/reverse directional control valve 8, as shown in FIG. 4, an annular groove 8*b* is preferably provided on the outer peripheral surface of a rotation spool 8*d* and a seal ring 8*c* is preferably fitted in the groove 8*b*. Seal rings that are made of gum-like elastic materials such as fluorine rubber and that have approximate rectangular cross sections are usable as a seal ring 8*c*. O-rings with circular cross sections may be used instead of such a seal ring 8*c*, and an annular groove may be provided in a cylindrical sliding surface 8*e* of the oil passage casing which receives the rotation spool 8*d* to fit the seal rings and O-rings therein instead of on the outer peripheral surface of the rotation spool 8*d* of the forward/reverse directional control valve 8.

Herein, hydraulic oil escapes into a drain through a gap between the outer peripheral surface of the rotation spool 8*d* of the forward/reverse directional control valve 8 and the cylindrical sliding surface 8*e* receiving the rotation spool 8*d*. The amount escaping into the drain increases in proportion to the increase in oil pressure. When the escaping amount excessively increases due to highly pressurized hydraulic oil, the amount of oil passing through the oil cooler 12 decreases and a lubricating oil temperature is therefore raised, resulting in a problem of lowered durability. As mentioned above, such a problem can be overcome by providing the seal ring 8*c*.

Although not illustrated, the two position control valve 4 mentioned above may be an electromagnetic valve. In this case, the operation of the directional control valve is controlled by a forward/reverse engagement sensor (not shown) which comprises a contact switch, a pressure sensor or the like that interlocks with the forward/reverse control lever 8*a*.

FIG. 2 is a sectional side view of a trolling device according to this embodiment. As shown in FIG. 2, in a trolling device 20 according to this embodiment, spools 22*s*, 23*s* constituting a low speed valve 22 and a pressure reducing valve 23 are slidably disposed with a pilot spring 24 interposed therebetween within a valve case 21.

The low speed valve 22 comprises a spring receiving recess 22*d* for receiving the pilot spring 24 formed thereon. Within the spring receiving recess 22*d* is formed a protrusion 22*a* which extends inside a coil spring constituting the pilot spring 24 to the side of the pressure reducing valve 23. The protrusion 22*a* may be a single piece or separate pieces as shown in FIG. 2.

The pressure reducing valve 23 comprises a pilot oil pressure chamber 23*b* provided inside the spool 23*s*. In the pilot oil pressure chamber 23*b* is disposed an adjusting spring 29 with a spring force lower than that of the pilot spring 24. The spring force of the adjusting spring 29 is adjustable by an adjusting screw 31.

In the low speed valve 22, the spool 22*s* is connected to a trolling lever 25 unrotatably about the axis of the trolling lever and axially freely slidably. Specifically, the spool 22*s* and the trolling lever 25 are coupled by a pin 27, and the pin 27 is freely slidably engaged with a key groove 26*a* of the trolling lever 25.

One end of the spool 22*s* is in contact with the pilot spring 24, while the other end receives pressure oil (corresponding to the primary pressure oil of the pressure reducing valve 23) from an oil gallery A. A triangular notch groove 22*b* for discharging the pressure oil into a drain oil gallery B depending on the angle of rotational operation of the trolling lever 25 is formed on the land of the spool 22*s*.

The pilot oil pressure chamber 23*b* is formed inside the spool 23*s* of the pressure reducing valve 23, and an orifice 23*c* for draining oil through a drain oil gallery F via an oil gallery E is formed from the pilot oil pressure chamber 23*b*.

The protrusion 22*a* has a drain oil passage 22*c* which comes in communication with the orifice 23*c* to discharge drain oil from the orifice 23*c* when in contact with the pressure reducing valve 23 during trolling described later.

An oil pressure adjusting method of the trolling device 20 will be described with reference to FIGS. 1 and 2. Firstly, the hydraulic oil from the pump 7 is supplied from an oil gallery C into the trolling device 20, and is discharged from an oil gallery D to be supplied to the forward and reverse clutches 2*a*, 2*b*. Secondly, when the forward and reverse clutches 2*a*, 2*b* are filled with hydraulic oil, the hydraulic oil acts as a secondary pressure oil on the pilot oil pressure chamber 23*b* of the pressure reducing valve 23, and moves the pressure reducing valve 23 to the right in the FIG. 2 (the side of the low speed valve 22). This movement causes a spool valve 23*a* of the pressure reducing valve 23 to block an oil passage leading from the oil gallery C to the oil gallery D. Therefore, the pressure of the hydraulic oil in the forward and reverse clutches 2*a*, 2*b* is not increased, producing a half-clutch state.

The pressure required for the movement of the pressure reducing valve 23 mentioned above relates to the oil pressure applied to the low speed valve 22, pilot spring 24, adjusting spring 29 and the oil pressure applied to the pilot oil pressure chamber 23*b* of the pressure reducing valve 23.

Firstly, in the state of FIG. 2 (*a*), that is, in a position where the triangular notch groove 22*b* and the oil gallery B are not in communication (closed position), the hydraulic oil provided from the oil gallery A presses the low speed valve 22, and the low speed valve 22 is positioned on the leftmost side (the side of the pressure reducing valve 23).

In such a state that the low speed valve 22 is positioned on the leftmost side, the biasing force of the pilot spring 24 disposed between the low speed valve 22 and pressure reducing valve 23 becomes large. Hence, the pressure reducing valve 23 becomes unable to move to the right to allow the spool valve 23*a* to block the oil passage from the oil gallery C to D. This makes the pressure of hydraulic oil which acts on the forward and reverse clutches 2*a*, 2*b* high and thus makes the clutches fully engaged, not producing a half-clutch state. In this state, the protrusion 22*a* is in contact with the pressure reducing valve 23 only at a contact surface E. Therefore, this contact surface E receives all the pressure by the primary pressure oil pushing the low speed valve 22 to the left.

Secondly, when the trolling lever 25 is rotated, a lever shaft 26 and a pin 27 engaging a key groove 26*a* provided on the lever shaft 26 rotates, and the low speed valve 22 integrated with the pin 27 rotates. When the low speed valve 22 is rotated in this manner to bring the triangular notch groove 22*b* and the oil gallery B into positions where they can be in communication (open position), the primary pressure oil from the oil gallery A is discharged from the oil gallery B via the triangular notch groove 22*b*. This lowers the pressure pushing the spool 22*s* by the primary pressure oil. The low speed valve 22 therefore moves to the right in the FIG. 2 (the side opposite to the pressure reducing valve 23) by the width of the triangular notch groove 22*b*, and the oil passage from the oil gallery A to the oil gallery B is blocked. When the oil passage is blocked, the pressure pushing the spool 22*s* by the primary pressure oil is increased, whereby the spool 22*s* is pushed to the left and the spool 22*s* moves to the left. Because of this movement, the oil passage from the oil gallery A to the oil gallery B is opened, the hydraulic oil from the oil gallery A is discharged again from the oil gallery B via the triangular notch groove 22*b*, the pressure pushing the spool 22*s* is lowered, and the spool 22*s* moves to the right. This opening and closing of the oil passage from the oil gallery A to the oil gallery B is repeated. The spool 22*s* reciprocates, while maintaining a desired position.

In contrast, when the low speed valve 22 moves to the right side in the FIG. 2 as mentioned above, the biasing force of the pilot spring 24 becomes small. Accordingly, the pressure reducing valve 23 moves to the right in the FIG. 2 by the oil pressure of the secondary pressure oil within the pilot oil pressure chamber 23*b* as shown in FIG. 2 (*b*) and by the adjusting spring 29 (the side of the low speed valve 22). When the spool 23*s* of the pressure reducing valve 23 moves to the right as mentioned above, the spool valve 23*a* blocks the oil passage from the oil gallery C to the oil gallery D, and therefore the pressure pushing the spool 23*s* by the secondary pressure oil in the pilot oil pressure chamber 23*b* is lowered. Because of this decrease in the pressure, the spool 23*s* moves to the left, the oil passage from the oil gallery C to the oil gallery D is opened, and the pressure pushing the spool 23*s* by the secondary pressure oil is increased. Therefore, the spool 23*s* is again moved to the right to block the oil passage from the oil gallery C to the oil gallery D. This opening and closing of the oil passage from the oil gallery C to the oil gallery D is repeated. The spool 23*s* reciprocates, while maintaining a desired position.

In this manner, the oil passage from the oil gallery C to the oil gallery D is repeatedly opened and closed. This prevents an increase in the pressure of the hydraulic oil in the forward and reverse clutches 2*a*, 2*b*. This produces a half-clutch state, reduces the number of revolutions of the propeller 4 regardless of the rotational speed of the engine 1, producing a trolling state. It should be noted that since the spools 22*s* and 23*s* reciprocate in a trolling state as mentioned above, the protrusion 22*a* of the low speed valve 22 is repeatedly brought in contact with and away from the pressure reducing valve 23.

As mentioned above, in order to change the state that the clutch is completely engaged to a half-clutch state, that is, a trolling state, the low speed valve 22 needs to be moved to the right in the FIG. 2, that is, the trolling lever 25 needs to be rotated.

Herein, in a known trolling device shown in FIG. 5, in a state that the clutch is fully engaged, the low speed valve is in contact with a pressure reducing valve sliding cylinder 30 on the contact surface E positioned on its outer periphery. However, the pressure of the contact surface E is very high because of high pressurization of the oil pressure setting. For this reason, if the contact area E is as large as in known devices, a great operational force for starting the rotation of the trolling lever 25 is required.

However, in the trolling device 20 according to this embodiment, the contact surface E is formed of the pressure reducing valve 23 and the protrusion 22*a* which is formed on the low speed valve. Therefore, the contact area is smaller than in known devices, and the force for operating the trolling lever 25 can be reduced. Moreover, the protrusion 22*a* ensures the drain oil passage from the orifice 23*c*, while its contact area with the pressure reducing valve 23 is reduced since the drain oil passage 22*c* is formed, whereby the force for operating the trolling lever 25 can be further reduced.

BRIEF DESCRIPTION OF DRAWINGS

FIG. 1 is a hydraulic circuit diagram containing a trolling device according to the present invention.

FIG. 2 is a cross-sectional view showing an embodiment of the trolling device (a) when the clutch is fully engaged and the trolling device (b) in a half-clutch state according to the present invention.

FIG. 3 is a cross-sectional view showing a marine gear according to this embodiment.

FIG. 4 is a cross-sectional view showing a forward/reverse directional control valve according to this embodiment.

FIG. 5 is a cross-sectional view showing a known trolling device.

EXPLANATION OF NUMERICAL SYMBOLS

20 Trolling device
22 Low speed valve
22*a* Protrusion
22*b* Triangular notch groove
22*c* Drain oil passage
22*s* Spool
23 Pressure reducing valve
23*b* Pilot oil pressure chamber
23*c* orifice
23*s* Spool
24 Pilot spring
25 Trolling lever

The invention claimed is:

1. A trolling device for controlling a clutch oil pressure by rotationally operating a trolling lever, the trolling device having a pressure reducing valve for reducing the clutch oil pressure and a low speed valve for adjusting the spring force of a pilot spring of the pressure reducing valve in conjunction with the trolling lever, the low speed valve comprising a spool connected on the trolling lever unrotatably relative to a lever shaft of the trolling lever and freely slidably along the lever shaft, the spool having one end being in contact with the pilot spring, and the other end receiving primary pressure oil of the pressure reducing valve, a notch groove for discharging the pressure oil into a drain depending on the angle of rotational operation of the trolling lever being formed on a land of the spool, the trolling device being so constituted that forward and reverse clutches are fully engaged by bringing the notch groove into a closed position and a trolling state is attained by bringing the notch groove into an open position, the pressure reducing valve comprising a spool provided with a pilot oil pressure chamber and an orifice formed therein, the pilot oil pressure chamber using the secondary pressure oil of the pressure reducing valve as a pilot pressure and the orifice for draining oil from the pilot oil pressure chamber to a drain, the low speed valve having a protrusion which extends inside a coil spring constituting the pilot spring to the side of the pressure reducing valve and comes into contact with the pressure reducing valve at least when the forward and reverse clutches are fully engaged, the protrusion having a drain oil passage which comes into communication with the orifice when in contact with the pressure reducing valve during trolling to discharge drain oil from the orifice.

* * * * *